United States Patent [19]

Hans et al.

[11] Patent Number: 4,634,055

[45] Date of Patent: Jan. 6, 1987

[54] INJECTION VALVE WITH UPSTREAM INTERNAL METERING

[75] Inventors: Waldemar Hans, Bamberg; Mathias Linssen, Litzendorf; Rudolf Sauer, Benningen, all of Fed. Rep. of Germany

[73] Assignee: Robert Bosch GmbH, Stuttgart, Fed. Rep. of Germany

[21] Appl. No.: 715,321

[22] Filed: Mar. 25, 1985

[30] Foreign Application Priority Data

May 19, 1984 [DE] Fed. Rep. of Germany ..... 3418762

[51] Int. Cl.[4] ..... F02M 61/04

[52] U.S. Cl. ..... 239/533.3; 239/533.12; 239/585

[58] Field of Search ..... 239/585, 533.2–533.12

[56] References Cited

U.S. PATENT DOCUMENTS

| | | | |
|---|---|---|---|
| 3,967,597 | 7/1976 | Schlagmuller et al. | 239/585 X |
| 4,317,542 | 3/1982 | Morishita et al. | 239/585 |
| 4,331,317 | 5/1982 | Kamai et al. | 239/585 X |
| 4,519,547 | 5/1985 | Kubach et al. | 239/585 |

FOREIGN PATENT DOCUMENTS

| | | | |
|---|---|---|---|
| 1582910 | 1/1981 | United Kingdom | 239/585 |

*Primary Examiner*—Andres Kashnikow

*Attorney, Agent, or Firm*—Edwin E. Greigg

[57] ABSTRACT

An injection nozzle for fuel injection systems of internal combustion engines is proposed, the nozzle being arranged to inject fuel into the intake tube of the engine. The injection valve includes a valve housing of ferromagnetic material, in which a tubular connection element which functions as a core and with which an armature is arranged to cooperate. Joined to the valve housing is a nozzle body having a valve seat with which a sealing section of a nozzle needle also is arranged to cooperate. The nozzle needle is guided by a plurality of guide sections in a guide bore of the nozzle body, and metering grooves are embodied on the second guide section disposed upstream of the first guide section. By metering fuel upstream of the valve seat, the fuel metering operation is prevented from being impaired by deposits.

6 Claims, 3 Drawing Figures

INJECTION VALVE WITH UPSTREAM INTERNAL METERING

BACKGROUND OF THE INVENTION

The invention is based on an injection valve as generally defined hereinafter. An injection valve is already known in which to avoid deposits at the metering cross sections, which are the result of combustion residues in the intake tube or residues from fuel evaporation and all of which can cause a change in the metered fuel quantity, the metering cross sections are shifted to upstream of the sealing section and embodied as surfaces at a guide section of the nozzle needle. The disadvantage here is that the metering cross sections can affect the formation of the fuel spray in an undesirable manner.

OBJECT AND SUMMARY OF THE INVENTION

The injection valve according to the invention and having the characteristics revealed later herein has the advantage over the prior art that the formation of deposits in the area of the fuel metering location is avoided, and this nozzle design which incorporates the fuel metering locations as taught herein are easy to manufacture, yet the metering openings per se have no effect on the fuel spray formation.

A particularly advantageous feature of the invention is the embodiment of the metering bores being located on the second guide section.

It is also advantageous to cause the metering openings to extend from an inflow bore in the nozzle needle to the circumference of the nozzle needle.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
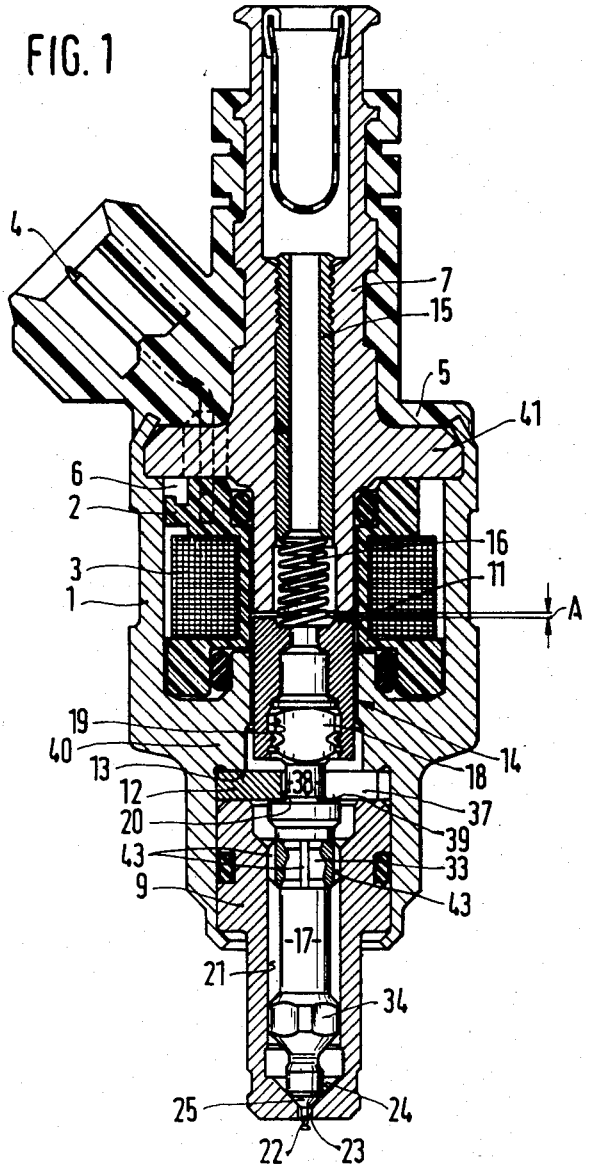
FIG. 1 shows in cross sectional view a first exemplary embodiment of an injection valve according to the invention.

The fuel injection valve shown in FIG. 1 for a fuel injection system of a mixture-compressing internal combustion engine having externally supplied ignition has a valve housing 1 of ferromagnetic material, in which a magnetic coil 3 is disposed on a coil carrier 2. The magnetic coil 3 is supplied with electric current via a plug connection 4, which is embedded in a plastic ring 5 that partially surrounds the valve housing 1.

The coil carrier 2 of the magnetic coil 3 is seated in a coil chamber 6 of the valve housing 1 on a tubular connection element 7 which carries the fuel, for instance gasoline, and as shown the tubular connection element 7 protrudes partway into the valve housing 1. Remote from the fuel element 7, the valve housing 1 partially surrounds a nozzle body 9.

The cylindrical armature 14 of the fuel injection valve is located between an end face 11 of the tubular connection element 7 and a stop plate 12, which has a predetermined thickness for the purpose of precisely adjusting the valve. Further, the stop plate 12 is disposed between an upper area of nozzle body 9 and an internal shoulder 13 of the valve housing 1. The armature 14 is made of corrosion-resistant magnetic material. A compression spring 16 which acts upon the armature 14 is disposed between the armature 14 and a tube insert 15, the latter being secured in the tubular connection element 7 by constricting the element 7. On the other end, a nozzle needle 17 is secured in the armature 14, being inserted into a bore 19 of the armature 14 with an annularly grooved end 18 and is retained therein by the armature material being pressed radially inward into the annular grooves of the annularly grooved end 18.

With radial play, the nozzle needle 17 penetrates a through opening 20 in the stop plate 12 and a guide bore 21 in the nozzle body 9 with the lower extremity of the needle 22 arranged to emerge from an injection opening 23 of the nozzle body 9. A conical valve seat face 24 which cooperates with a conical sealing section 25 on the nozzle needle 17 is formed between the guide bore 21 of the nozzle body 9 and the injection opening 23. The length of the nozzle needle 17 and of the armature 14 is dimensioned, beginning at the sealing section 25, such that in the nonexcited state of the magnetic coil 3 the armature 14 leaves a working gap A open with respect to the end face 11 of the tubular connection element 7.

The nozzle needle 17 has two guide sections 33 and 34, which guide the nozzle needle 17 in the bore 21, with the first guide section 34 located upstream of the sealing section 25 and embodied for example as a rectangle, while the second guide section 33 is disposed upstream of the first guide section 34. The two guide sections lie at opposite extremities of a constricted area of said nozzle needle.

Between the guide opening 20 and the circumference of the stop plate 12, a recess 37 is provided, the inside diameter of which recess is greater than the diameter of the nozzle needle in the corresponding region 38 of the nozzle needle 17, that is, it is of greater diameter between the annularly grooved end 18 and the stop shoulder 39 of the nozzle needle 17. In the excited state of the magnetic coil 3, the armature 14 is moved in the opening direction of the nozzle needle 17 counter to the force of the compression spring 16 and rests with the stop shoulder 39 on the stop plate 12.

The magnetic flux is conducted through the jacket of the valve housing 1 via a magnetic flux conductor step 40 to the cylindrical armature 14 and from there back to the valve housing via the tubular connection element 7, which acts as a core and has a conductive flange 41. The magnetic flux conductor step 40 of the valve housing 1 points radially inward and surrounds the armature 14.

In accordance with the invention, metering openings are embodied in the otherwise cylindrically embodied second guide section 33. These openings extend axially from upstream of the second guide section 33 to downstream of the second guide section and are shown in the drawing by way of example as metering grooves 43. The metering grooves 43 are embodied such that they are open toward the circumference of the second guide section 33. Four metering grooves 43, for example, can be provided on the second guide section 33. The metering openings could also be embodied as flattened areas on the second guide section 33 that are open toward the circumference.

Figure 2:
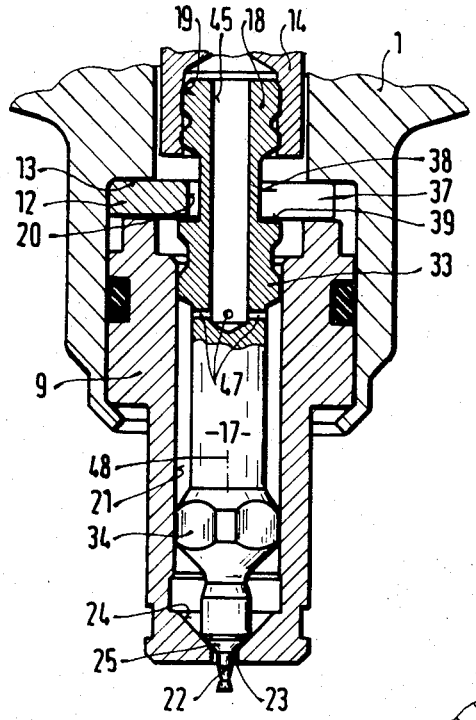
FIG. 2 shows a detailed view in cross section of a second exemplary embodiment of an injection valve according to the invention.
Figure 3:
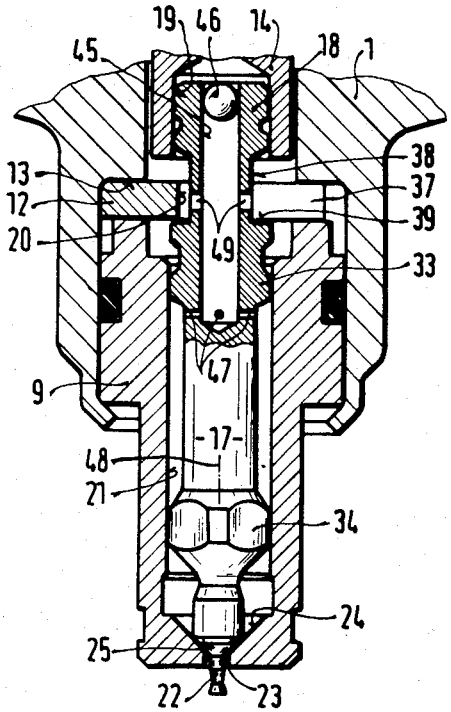
FIG. 3 shows another detailed view in cross section of a third exemplary embodiment of an injection valve according to the invention.

In the exemplary embodiments of injection valves shown in part in FIGS. 2 and 3, the elements remaining the same as and functioning like those of the exemplary embodiment shown in FIG. 1 are identified by the same reference numerals. The nozzle needles 17 of the exemplary embodiments of FIGS. 2 and 3 have a blind inflow bore 45, which in the exemplary embodiment of FIG. 2 is open toward the end face on the annularly grooved end 18, while in the exemplary embodiment of FIG. 3 the inflow bore 45 has subsequently been closed off at the annularly grooved end 18, for instance by pressing a ball 46 into it. From the inflow bore 45, as shown in the view of FIG. 2, metering openings 47 are arranged for fuel to flow in such a manner toward the circumference of the nozzle needle 17 that the metering openings 47 discharge into the guide bore 21 between the first guide section 34 and the second guide section 33, or in other words downstream of the second guide section 33. Four metering openings 47, by way of example, may be provided, which extend at right angles or at an inclination to the longitudinal axis 48 of the nozzle needle. In the exemplary embodiment of FIG. 2, the fuel delivered via the tubular connecting element 7 flows virtually completely through the hollow armature, without flowing around the armature 14, to the inflow bore 45, while in the exemplary embodiment of FIG. 3 the armature 14 has a flow of fuel around it and inflow openings 49 are provided in the nozzle needle 17 upstream of the second guide section 33, these openings 49 being arranged to lead from the circumference of the nozzle needle to the inflow bore 45.

At the metering grooves 43 and the metering openings 47 of FIG. 1, a pressure drop of approximately 80 to 85% should take place during metering, while the remaining pressure, which serves to prepare the fuel, decreases between the injection opening 23 and the lower extremity of the needle 22. By disposing the metering openings 43, 47 upstream of the valve seat face 24, deposits in the metering openings 43, 47 are prevented. Deposits in the relatively wide gap between the extremity of the needle 22 and the wall of the injection opening 23 cause only a negligible effect on the metered fuel quantity. By disposing the metering openings 43, 47 upstream of the first guide section, an influence on the fuel spray formation is substantially avoided.

The foregoing relates to preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An injection valve for fuel injection systems of internal combustion engines comprising a nozzle body arranged to receive a nozzle needle therein, said nozzle needle having a constricted area disposed between first and second guide sections for said nozzle needle, said first guide section being disposed above a conical valve seat face, said second guide section being disposed upstream of said first guide section, said first guide section including means defining fuel flow passages, said constricted area being arranged to terminate below said second guide section and in close proximity to means defining fuel metering openings, said means defining fuel metering openings having a substantially smaller cross-section than that of said fuel flow passages.

2. An injection valve as defined by claim 1, further wherein said metering openings are embodied on said second guide section, said second guide section further including a circumference.

3. An injection valve as defined by claim 2, further wherein said metering openings are embodied as axially extending and open toward said circumference of said second guide section.

4. An injection valve as defined by claim 3, further wherein said metering openings comprise metering grooves.

5. An injection valve as defined in claim 1, further wherein said nozzle needle further includes a blind inflow bore in a zone remote from said sealing section, by way of which bore fuel is arranged to flow from upstream of said second guide section to said metering openings, which lead from the inflow bore to said circumference of said nozzle needle between said first and said second guide sections.

6. An injection valve as defined by claim 5, further wherein said blind inflow bore has means defining openings adapted to allow fuel to flow into said bore of said nozzle needle upstream of said second guide section.

* * * * *